US006894597B2

(12) United States Patent
Skinner et al.

(10) Patent No.: US 6,894,597 B2
(45) Date of Patent: May 17, 2005

(54) AXIALLY POTTED PROGRESSIVE WOUND REMOTE MOUNT IGNITION COIL

(75) Inventors: Albert Anthony Skinner, Anderson, IN (US); Kenneth P. Senseman, Noblesville, IN (US); Colin Hamer, Carmel, IN (US); Gary Lee Adams, Alexandria, IN (US)

(73) Assignee: Delphi Technologies, Inc., Troy, MI (US)

( * ) Notice: Subject to any disclaimer, the term of this patent is extended or adjusted under 35 U.S.C. 154(b) by 79 days.

(21) Appl. No.: 10/372,151

(22) Filed: Feb. 21, 2003

(65) Prior Publication Data

US 2004/0164832 A1 Aug. 26, 2004

(51) Int. Cl.[7] ..... H01F 27/02

(52) U.S. Cl. ..... 336/90; 336/92; 336/96; 336/107; 123/635

(58) Field of Search ..... 336/96, 92, 90, 336/110, 107, 198; 123/634, 635, 647

(56) References Cited

U.S. PATENT DOCUMENTS

| | | | | |
|---|---|---|---|---|
| 3,886,434 A | | 5/1975 | Schreiner | 321/27 R |
| 4,763,094 A | * | 8/1988 | Kojima | 336/92 |
| 4,794,361 A | | 12/1988 | Young | 336/189 |
| 5,015,982 A | | 5/1991 | Skinner et al. | 336/69 |
| 5,015,984 A | * | 5/1991 | Vialaneix | 336/197 |
| 5,032,814 A | * | 7/1991 | Badaud | 336/65 |
| 5,109,209 A | * | 4/1992 | Ida et al. | 336/96 |
| 5,257,611 A | * | 11/1993 | Chapekis et al. | 123/634 |
| 5,416,459 A | * | 5/1995 | Ida et al. | 336/96 |
| 5,444,427 A | | 8/1995 | Ida et al. | 336/198 |
| 5,706,792 A | | 1/1998 | Boyer et al. | 123/634 |
| 5,767,758 A | | 6/1998 | Sakamaki | 336/84 M |
| 5,929,736 A | | 7/1999 | Sakamaki et al. | 336/96 |
| 6,087,918 A | | 7/2000 | Henry et al. | |
| 6,156,264 A | | 12/2000 | Johnston et al. | |
| 6,188,304 B1 | | 2/2001 | Skinner et al. | |
| 6,215,385 B1 | | 4/2001 | Ogden | |
| 6,216,679 B1 | | 4/2001 | Skinner et al. | 123/635 |
| 6,232,863 B1 | | 5/2001 | Skinner et al. | |
| 6,276,348 B1 | | 8/2001 | Skinner et al. | |
| 6,422,225 B1 | | 7/2002 | Hamer et al. | |
| 6,437,674 B1 | | 8/2002 | Hamer et al. | |
| 6,556,116 B2 | | 4/2003 | Skinner et al. | |
| 6,556,118 B1 | | 4/2003 | Skinner | |
| 6,615,811 B1 | | 9/2003 | Butler et al. | |
| 6,622,711 B1 | | 9/2003 | Skinner et al. | |

FOREIGN PATENT DOCUMENTS

| | | |
|---|---|---|
| DE | 10110280 | 9/2001 |
| EP | 0859383 | 8/1998 |
| EP | 0951026 | 10/1999 |

* cited by examiner

*Primary Examiner*—Ann Mai
(74) *Attorney, Agent, or Firm*—Jimmy L. Funke

(57) ABSTRACT

An axially potted progressive wound remote mount ignition coil (axially potted ignition coil) includes a coil case, at least one coil assembly, and a quantity of potting material. Each coil assembly is progressively wound. The coil case includes a coil cavity for each coil assembly, a primary connector, and two secondary connectors for each coil cavity. Each primary coil is connected to the primary connector and an end of each secondary coil is connected to a single secondary connector. A quantity of potting material is poured over the open end of each coil cavity. A second embodiment of the axial potted ignition coil includes a modular coil case, at least one coil assembly, and a quantity of potting material. The modular coil case includes at least one coil tube, a rear end cap and a forward end cap. Each coil assembly is inserted into a respective coil tube.

8 Claims, 4 Drawing Sheets

AXIALLY POTTED PROGRESSIVE WOUND REMOTE MOUNT IGNITION COIL

TECHNICAL FIELD

The present invention relates generally to ignition coils and more specifically to an axially potted progressive wound remote mount ignition coil which requires less potting material than that of the prior art, and thus reduces the potential of the potting material cracking.

BACKGROUND OF THE INVENTION

The state-of-the-art discloses a coil assembly placed in a U-shaped trough formed in a coil case. The coil case includes at least one U-shaped trough. A quantity of potting material is poured over the entire length of each coil assembly to insulate thereof. The drawback to this assembly method is that the large area of potting material covering the coil assembly is prone to cracking. A coil case with cracked potting material may cause a premature failure of the ignition coil. Cracked potting is also undesirable for numerous other reasons.

SUMMARY OF THE INVENTION

The present invention is an axially potted progressive wound remote mount ignition coil, which reduces the amount of potting material and the surface area of potting material subject to cracking. The axially potted progressive wound remote mount ignition coil (axially potted ignition coil) includes a coil case, at least one coil assembly and a quantity of potting material. Potting material is basically a high voltage insulator. Each coil assembly includes a core, a primary coil, a secondary winding spool and a secondary coil. The primary coil is preferably wound around the core such that the two ends thereof are at one end of the core. The primary coil is inserted into the secondary winding spool and the primary coil is retained in the secondary winding spool with a retention cap. The secondary coil is wound around the outer perimeter of the secondary winding spool, such that each end of the secondary coil is disposed at opposite ends of the secondary winding spool. The coil case includes a coil cavity for each coil assembly, a primary connector and two secondary connectors extending from each coil cavity. The primary connector is preferably disposed adjacent an open end of the at least one coil cavity. Primary connector pins are preferably molded as an integral part of the primary connector. A single secondary connector extends radially from each end of each coil cavity. A single secondary connector terminal is located in each secondary connector.

A single coil assembly is inserted into each coil cavity. Each end of each primary coil is connected to one of the primary connector pins. Preferably, a spring loaded secondary contact terminates each end of the secondary coil. The spring loaded secondary contact makes an electrical connection with the secondary connector terminal, when the coil assembly is inserted into its respective coil cavity. After each coil assembly is inserted and connected, potting material is poured into the open end of each coil cavity. After the potting material cures, the axially potted ignition coil is ready for use.

A second embodiment of the axially potted ignition coil includes a modular coil case, at least one coil assembly, and a quantity of potting material. Each coil assembly is identical to that of the first embodiment. The modular coil case includes a coil tube for each coil assembly, a rear end cap, and a forward end cap. The modular coil case of the second embodiment reduces the complexity of the mold required to make the coil case of the first embodiment. The rear end cap is attached to one end of the at least one coil tube, and the forward end cap is attached to the other end of the at least one coil tube, collectively thereby serially connecting together a plurality of coil tubes. The-forward end cap includes a primary connector and a potting access opening adjacent an end of each coil tube. Primary connector pins are preferably molded as an integral part of the primary connector. A single secondary connector extends radially from a wall of each coil tube at each end thereof. A single secondary connector terminal is inserted into each secondary connector.

Each end of each primary coil is electrically connected to a primary connector pin. Preferably, a spring loaded secondary contact terminates each end of the secondary coil. The spring loaded secondary contact makes an electrical connection with the secondary connector terminal, when the coil assembly is inserted into its respective coil cavity. Each coil assembly is inserted into its respective coil tube, before attachment of the connector end cap. Finally, potting material is poured through a potting access opening into the open end of each coil tube. After the potting material cures, the axial potted ignition coil is ready for use.

Accordingly, it is an object of the present invention to provide an axially potted ignition coil, which reduces the amount of potting material required to pot a coil assembly in a coil case.

This and additional objects, features and advantages of the present invention will become clearer from the following specification of a preferred embodiment.

DESCRIPTION OF THE PREFERRED EMBODIMENT

Figure 1:
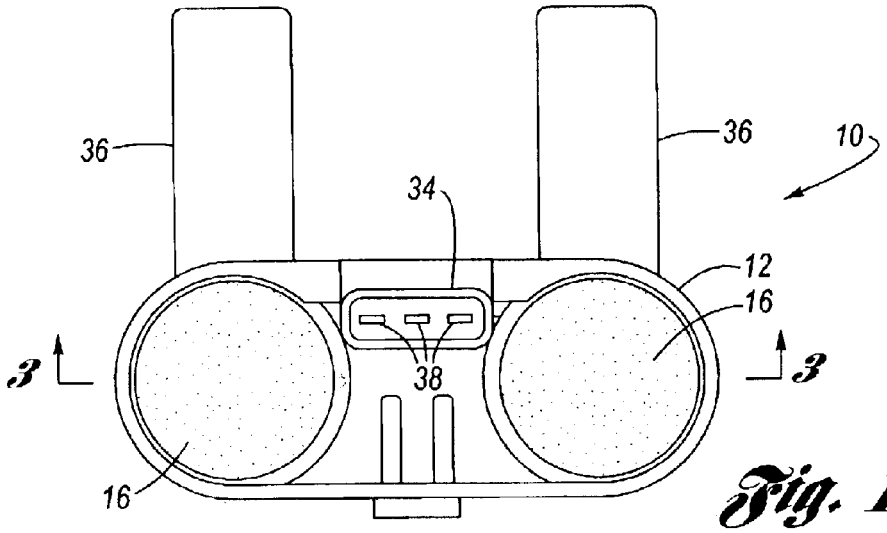
FIG. 1 is an end view of an axially potted ignition coil according to the present invention.
Figure 2:
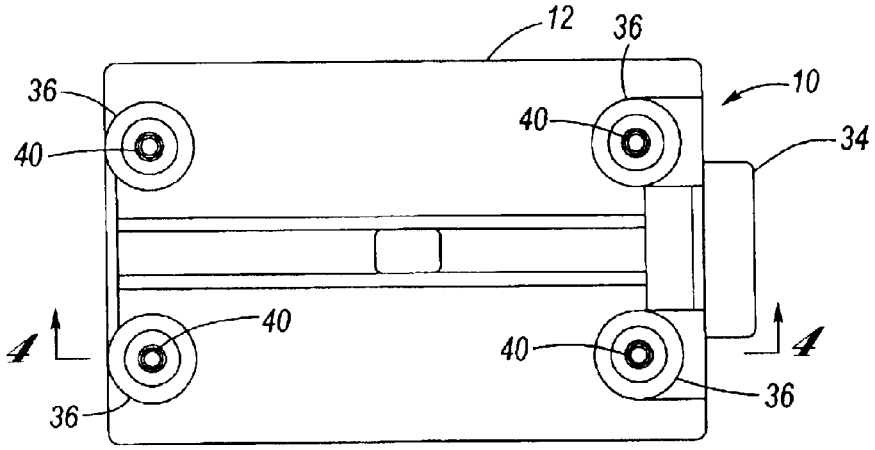
FIG. 2 is a top plan view of the axially potted ignition coil of FIG. 1.
Figure 3:
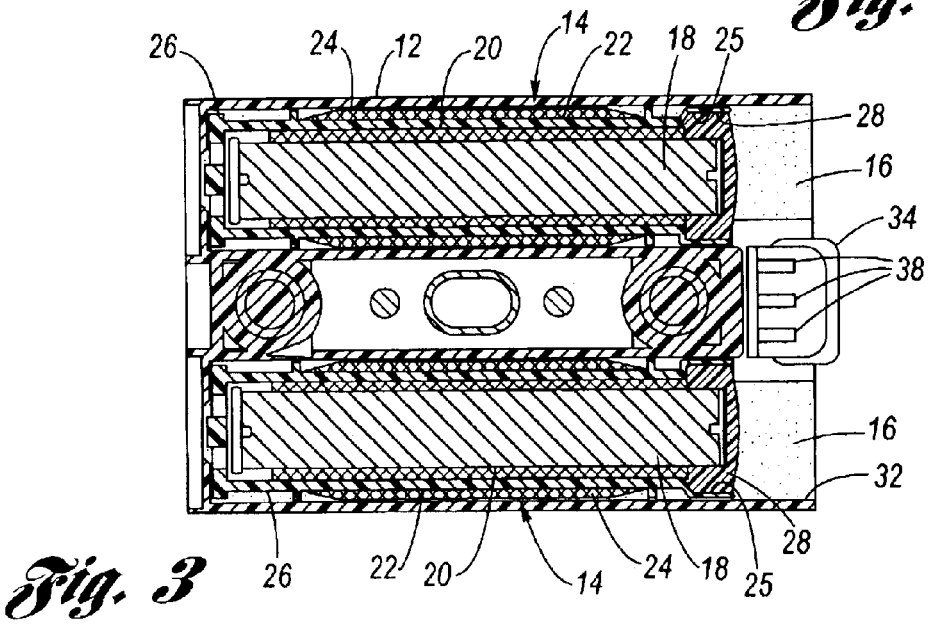
FIG. 3 is a cross-sectional view of the axially potted ignition coil, seen along line 3—3 of FIG. 1.

Referring now to the Drawings, FIGS. 1 through 3 show an axially potted ignition coil 10 according to the present invention. The axially potted ignition coil 10 includes a coil case 12, at least one coil assembly 14, and a quantity of potting material 16. Each coil assembly 14 includes a core 18, a primary coil 20, a secondary winding spool 22 and a secondary coil 24. A retention cap 28 is placed onto one end of the core 18 and the primary coil 20 is preferably wound around the core such that two ends thereof are at the retention cap end of the core. The secondary winding spool 22 includes a spool portion 26. The spool portion 26 includes a spool coil cavity 30 which is sized to receive the primary coil 20 wrapped around the core 18. The primary coil 20 wrapped around the core 18 is inserted into the spool coil cavity 30. The retention cap 28 is preferably inserted into a counter bore 25 of the spool portion 26. The retention cap 28 is retained in the counter bore 25 with any suitable process. The retention cap 28 prevents movement of the primary coil 20 and core 18 in the spool coil cavity 30. The secondary coil 24 is wound around an outer perimeter the secondary winding spool 22, such that each end of the secondary coil 24 is disposed at opposite ends of the secondary winding spool 22.

Figure 4:
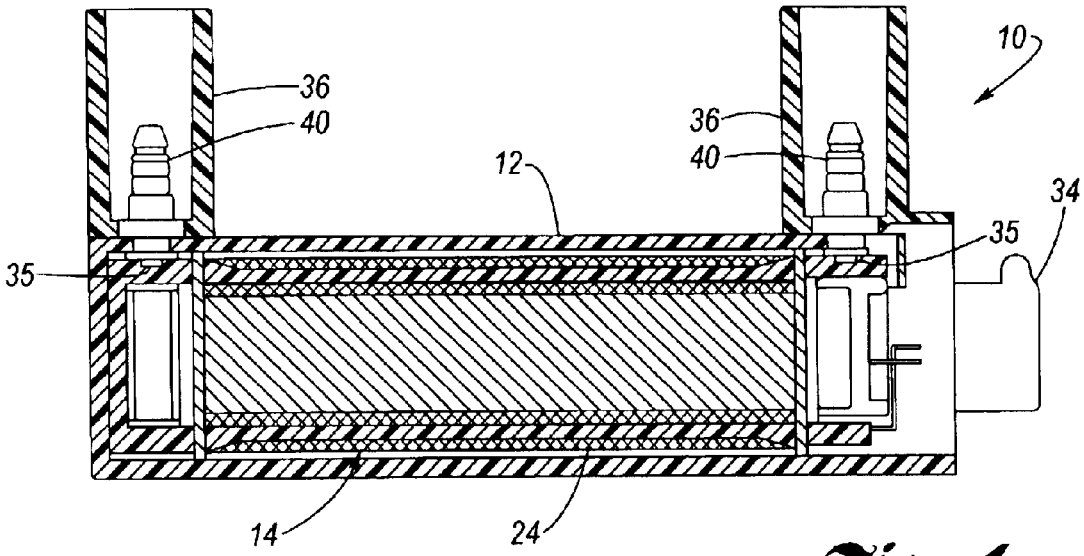
FIG. 4 is a cross-sectional view of an axially potted ignition coil, seen along line 4—4 of FIG. 2.

With reference to FIG. 4, a spring loaded secondary contact 35 preferably terminates each end of the secondary coil 24. The coil case 12 includes a coil cavity 32 for each coil assembly 14, a primary connector 34, and two secondary connectors 36 for each coil cavity 32. The primary connector 34 is disposed adjacent an open end of each coil cavity 32. Primary connector pins 38 are preferably molded as an integral part of the primary connector 32. A single secondary connector 36 extends radially from a wall of each coil cavity 32 at each end thereof. A single secondary connector terminal 40 is inserted into each secondary connector 36. The axially potted ignition coil 10, as depicted, includes two coil assemblies 14; however, the axially potted ignition coil 10 may include only one or more than two coil assemblies 14.

Figure 5:
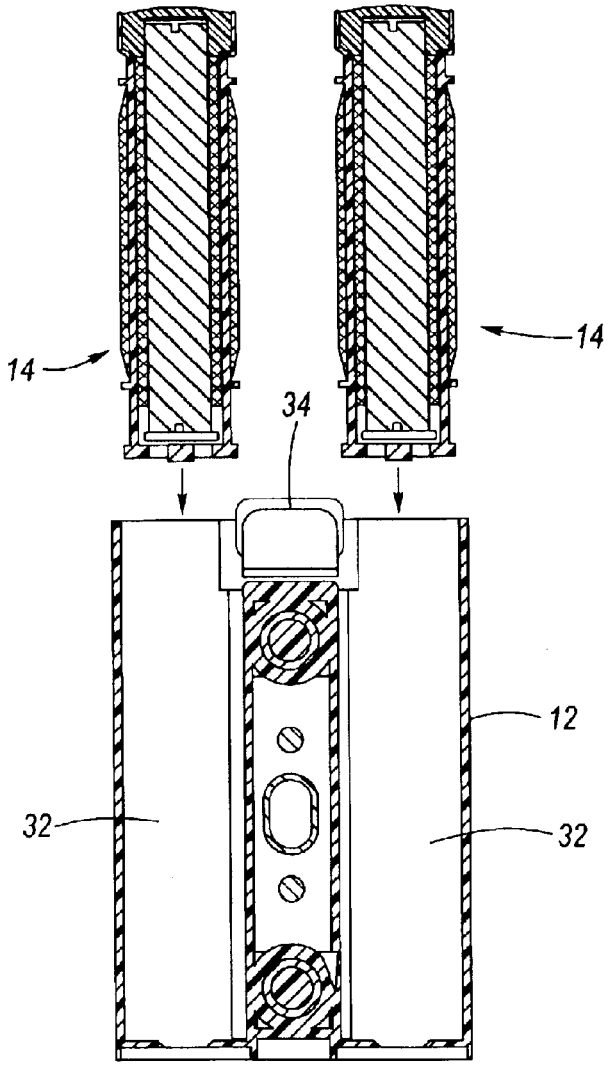
FIG. 5 is an exploded, partly sectional view of the axially potted ignition coil according to the present invention, shown prior to insertion of the coil assemblies thereof.
Figure 6:
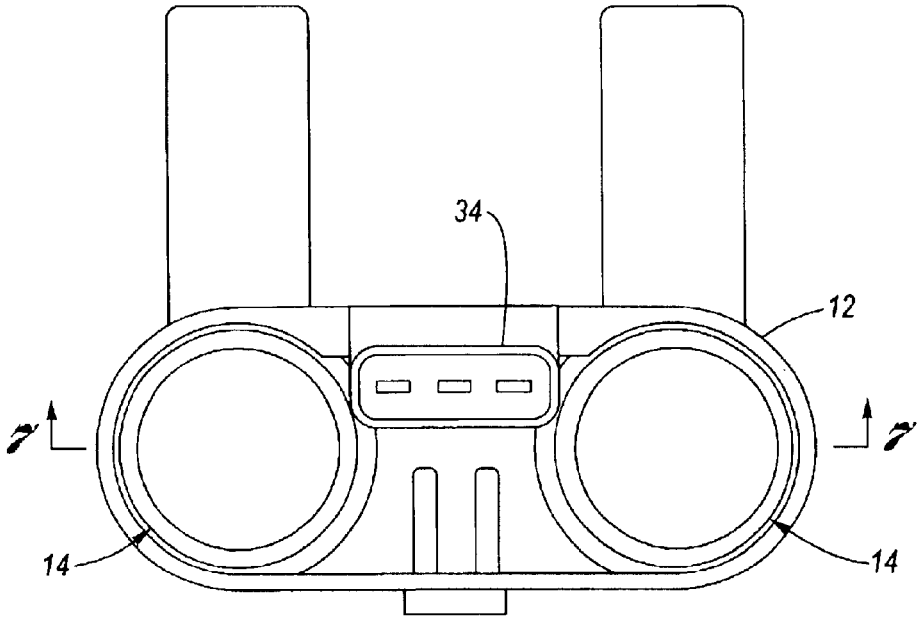
FIG. 6 is an end view of the coil case with two coil assemblies inserted therein, prior to application of potting material in accordance with the methodology of the present invention.
Figure 7:
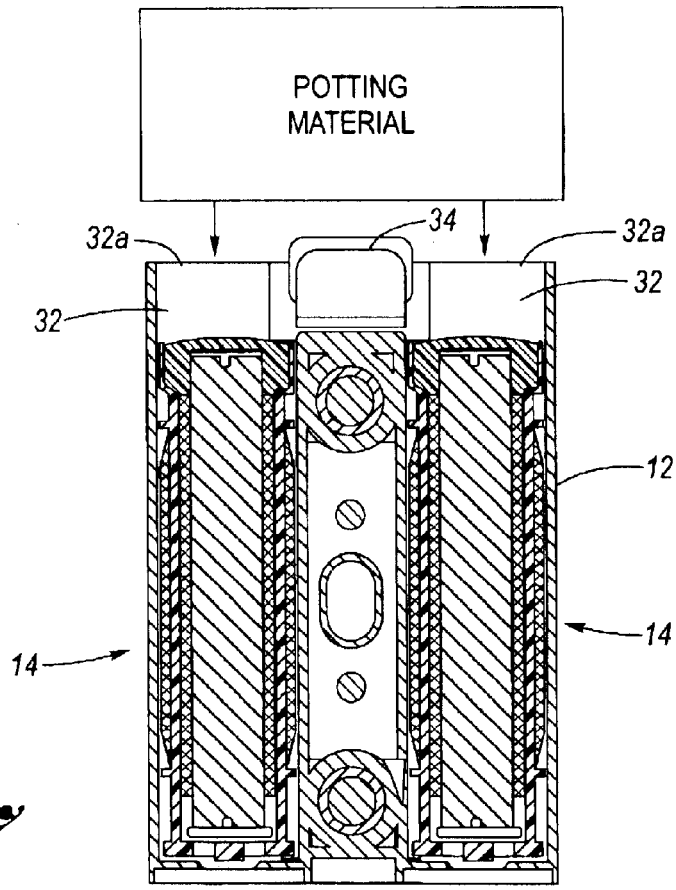
FIG. 7 is a cross-sectional view, seen along line 7—7 of FIG. 6.
Figure 8:
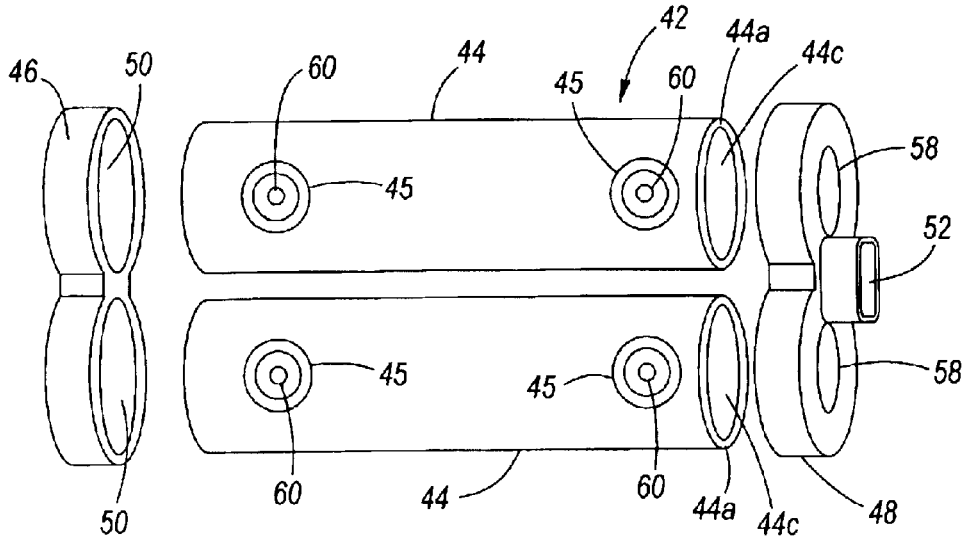
FIG. 8 is a perspective view of a second embodiment of the axially potted ignition coil according to the present invention which utilizes a modular coil case.
Figure 9:
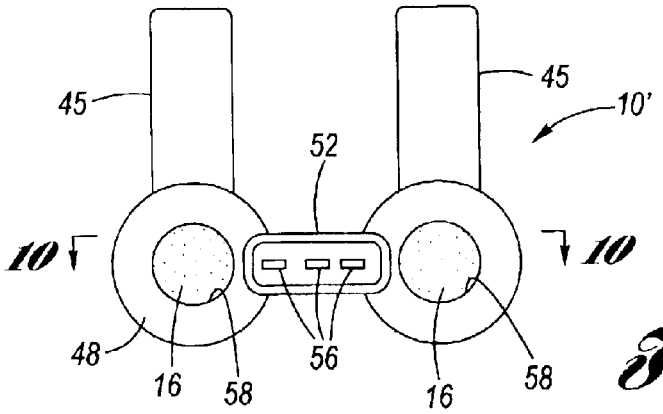
FIG. 9 is an end view of the second embodiment of the axially potted ignition coil.
Figure 10:
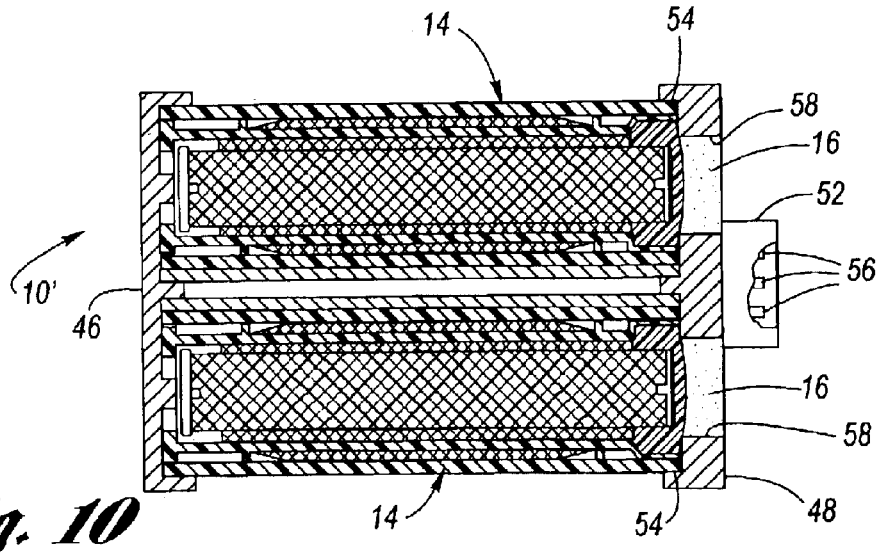
FIG. 10 is across-sectional view, seen along lines 10—10 of FIG. 9.

With reference to FIG. 5, a single coil assembly 14 is inserted into each coil cavity 32, such that the two spring loaded spring contacts 35 align with the two secondary connector terminals 40. Each coil assembly 14 must also be inserted such that the two primary coil ends are adjacent the open end of the coil cavity 32. Each end of each primary coil 20 is connected to one of the primary connector pins 38. If more than one coil assembly 14 is used, the high side of each primary coil 20 is preferably electrically connected to a single primary connector battery pin. The secondary connector terminal 40 may be molded or inserted into each secondary connector 36. If the secondary connector terminal 40 is inserted, it may be retained in the secondary connector 36 with any suitable process. Each spring loaded secondary contact 35 makes an electrical connection with the secondary connector terminal 40, when the coil assembly 14 is correctly aligned in the coil cavity 32. After each coil assembly 14 is inserted into its respective coil cavity 32, each end of the primary coil 20 is connected to a specific primary connector contact 38. Finally, with the coil case 12 upstanding and the open ends thereof atop, potting material 16 is poured into the open end 32*a* of each coil cavity 32 with any suitable filling process. The potting material 16 is preferably an epoxy type, but other types of suitable potting material may also be used. After the potting material 16 cures, the axial potted ignition coil 10 is ready for use.

A second embodiment of the axial potted ignition coil 10' includes a modular coil case 42, at least one coil assembly 14, and a quantity of potting material 16. The modular coil case 42 includes a coil tube 44 for each coil assembly 14, a rear end cap 46, and a forward end cap 48. The modular coil case 42 reduces the complexity of the mold required to make the coil case 12 of the first embodiment. The coil tube 44 defines a coil cavity 44*c* having at least one open end 44*a*, and includes a secondary connector 45 extending radially from each end thereof. A single secondary connector terminal 60 is molded or inserted into each secondary connector 45. The end cap 46 includes a tube cavity 50 for each coil tube 44. The tube cavity 50 is sized to receive the outer perimeter of a single coil tube 44. The rear end cap 46 is secured to one end of the at least one coil tube 44 with any suitable attachment process.

The forward end cap 48 includes a primary connector 52 and at least one tube cavity 54. The primary connector 52 includes at least two primary connector pins 56. The primary connector pins 56 are preferably molded as an integral part of the primary connector 52. Each end of each primary coil 20 is electrically connected to one of the primary connector pins 56. If more than one coil assembly 14 is used, the high side of each primary coil is preferably electrically connected to a single primary connector battery pin. Each tube cavity 54 is sized to receive the outer perimeter of the other end of a single coil tube 44. The forward end cap 48 is attached to the at least one coil tube 44 with any suitable attachment process, wherein the coaction of the rear and forward end caps serially connect together a plurality of coil tubes. A potting opening 58 is formed through the connector end cap 48 adjacent each tube cavity 54.

A single coil assembly 14 is inserted into each coil tube 44, such that the two spring loaded spring contacts 35 of the coil assembly 14 align with the two secondary connector terminals 60. Each coil assembly 14 must also be inserted such that the two primary coil ends are adjacent the open end of the coil cavity 32. Each end of each primary coil 20 is electrically connected to one of the primary connector pins 56. Each spring loaded secondary contact 35 makes an electrical connection with a single secondary connector terminal 60, when the coil assembly 14 is correctly aligned in its respective coil tube 44.

After each coil assembly 14 is inserted into its respective coil tube 44, each end of the primary coil is electrically connected to a specific primary connector pin 56. With the coil tubes 44 upstanding so that the potting openings 58 are vertically atop, potting material 16 is poured through the potting opening 58 into the coil tube 44 with any suitable filling process. The potting material 16 is preferably an epoxy type, but other types of suitable potting material may also be used. After the potting material cures, the axial potted ignition coil 10' is ready for use.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An axially potted progressive wound remote mount ignition coil, comprising:

a coil case having formed therein at least one coil cavity having an open end;

at least one coil assembly, wherein one coil assembly is provided for each coil cavity, respectively;

at least one secondary connector interfaced with said coil case and electrically connected to a selected said coil assembly;

a primary connector connected with said coil case and electrically connected with each said coil assembly; and a potting material filling the open end of said at least one coil cavity and trapping each said coil assembly in its respective coil cavity.

2. The ignition coil of claim 1, wherein each said coil assembly comprises:

a core;

a primary coil wrapped around said core;

a secondary winding spool, wherein said core and said primary coil being received therein; and a secondary coil wrapped around said secondary winding spool;

wherein said secondary winding is electrically connected to at least one secondary connector, and wherein said primary winding is electrically connected to said primary connector.

3. The ignition coil of claim 2, wherein said at least one coil cavity comprises a pair of coil cavities.

4. An axially potted progressive wound remote mount ignition coil, comprising:

at least one coil tube defining a coil cavity having an open end;

at least one coil assembly, wherein one coil assembly is provided for each coil cavity, respectively;

at least one secondary connector interfaced with a respective said at least one coil tube and electrically connected to a selected said coil assembly;

a primary connector electrically connected with each said coil assembly; and a potting material filling the open end of said at least one coil cavity and trapping each said coil assembly in its respective coil cavity.

5. The ignition coil of claim 4, wherein each said coil assembly comprises:

a core;

a primary coil wrapped around said core;

a secondary winding spool, wherein said core and said primary coil being received therein; and a secondary coil wrapped around said secondary winding spool;

wherein said secondary winding is electrically connected to at least one secondary connector, and wherein said primary winding is electrically connected to said primary connector.

6. The ignition coil of claim 4, wherein said at least one coil tube comprises a modular coil case comprising a plurality of coil tubes having a rear end, said ignition coil further comprising:

a rear end cap configured to interfit with each said rear end of each said coil tube; and a forward end cap configured to interfit with the open end of each said coil tube, said forward end cap having an opening at each said coil cavity of each said coil tube;

wherein said rear and forward end caps coact to serially conjoin said plurality of coil tubes, and wherein said potting material fills through each said opening.

7. The ignition coil of claim 6, wherein said primary connector is connected with said forward end cap.

8. The ignition coil of claim 7, wherein each said coil assembly comprises:

a core;

a primary coil wrapped around said core;

a secondary winding spool, wherein said core and said primary coil being received therein; and a secondary coil wrapped around said secondary winding spool;

wherein said secondary winding is electrically connected to at least one secondary connector, and wherein said primary winding is electrically connected to said primary connector.

* * * * *